United States Patent [19]

Rockwell et al.

[11] Patent Number: 4,627,619

[45] Date of Patent: Dec. 9, 1986

[54] ABDOMINAL AND BACK WEIGHT TYPE EXERCISING DEVICE

[75] Inventors: Gary Rockwell, LaGrange, Ga.; Randall Bartlett, Opelika, Ala.

[73] Assignee: Diversified Products Corporation, Opelika, Ala.

[21] Appl. No.: 696,705

[22] Filed: Jan. 31, 1985

[51] Int. Cl.[4] ..... A63B 21/00

[52] U.S. Cl. ..... 272/134; 272/117; 272/123; 272/144

[58] Field of Search ..... 272/116, 117, 118, 123, 272/134, 130, 144, 143

[56] References Cited

U.S. PATENT DOCUMENTS

| | | | |
|---|---|---|---|
| 3,998,454 | 12/1976 | Jones | 272/117 |
| 4,200,279 | 4/1980 | Lambert | 272/134 X |
| 4,226,415 | 10/1980 | Wright | 272/134 X |
| 4,319,747 | 3/1982 | Rodgers | 272/144 X |
| 4,405,128 | 9/1983 | McLaughlin et al. | 272/117 |
| 4,411,421 | 10/1983 | Hershberger | 272/134 X |
| 4,500,089 | 2/1985 | Jones | 272/118 X |

FOREIGN PATENT DOCUMENTS

| | | | |
|---|---|---|---|
| 457018 | 7/1913 | France | 272/117 |

OTHER PUBLICATIONS

Advertisement for "In-Home Fitness System", in the Sunday Supplement to the Washington Post, 6/20/82.

*Primary Examiner*—Richard J. Apley
*Assistant Examiner*—Robert W. Bahr
*Attorney, Agent, or Firm*—Banner, Birch, McKie & Beckett

[57] ABSTRACT

An abdominal/back exerciser is disclosed. The exerciser includes a frame having spaced side members and a seat attached to the frame between the side members. Foot braces extend between the side members on each side of the seat. A generally U-shaped lever assembly includes parallel side legs and a padded torso-engaging member interconnecting the side legs. The side legs are pivotally connected to the side members at a pivot axis intermediate their length. Weights are mounted at the distal end of each side leg. A stop mechanism limits the downward movement of the side legs to a start position wherein the torso-engaging member is elevated above the seat, whereby a user seated on the seat can lean against the torso-engaging member and rotate the lever assembly to raise the weights thereby exercising his abdominal muscles when facing the torso-engaging member or exercising his lower back muscles when seated with his back to the torso-engaging member.

5 Claims, 2 Drawing Figures

ABDOMINAL AND BACK WEIGHT TYPE EXERCISING DEVICE

BACKGROUND OF THE INVENTION

This invention relates to physical exercising apparatus and, more particularly, to exercising apparatus specifically designed for exercising the muscles of the abdomen and back.

A wide variety of exercising apparatus abounds in the prior art. Many of these are multi-purpose exercisers which are usable in many ways for performing a wide variety of exercises. Others are designed to exercise specific muscle groups or specific areas of the body. The abdominal muscles are one such group, with several machines specifically designed for exercising those muscles.

The abdominal muscles and those of the lower back are antagonistic, i.e., they oppose and limit the movement of one another. Proper stength and muscle tone of each group is important for proper posture and overall physical health. However, the muscles of the lower back tend to be quite neglected, as evidenced by the large percentage of the population with lower back problems. Indeed, few exercise devices are designed specifically for exercising those muscles. Considering the interaction between the abdominal muscles and those of the lower back, it would be highly desirable to have available a device for exercising both groups of muscles.

SUMMARY OF THE INVENTION

It is, therefore, an object of the invention to provide an exercising apparatus for exercising the abdominal muscles and those of the lower back.

Another objection of the invention is to provide such an apparatus which involves little, if any, adjustment or reconfiguration when changing from one type of exercise to the other.

Another object of the invention is to provide such an apparatus which can provide a wide range of variable resistance, beginning at very low values.

Another object of the invention is to provide such an apparatus which is easily adjustable to accomodate users of different size.

Another object of the invention is to construct the apparatus in a relatively simple and inexpensive manner.

These and other objects of the invention are accomplished by providing an abdominal/back exerciser comprising a frame having spaced side members; a seat attached to the frame between the frame side members; foot braces between the frame side members on each side of the seat; a generally U-shaped lever assembly having parallel side legs pivoted intermediate their length to the frame side members about a pivot axis, and a padded torso-engaging member interconnecting the side legs; a weight mounting mechanism at the distal end of the side legs for mounting selected weights; and a stop mechanism limiting downward movement of the side legs to a start position wherein the torso-engaging member is elevated above the seat, whereby a user seated on the seat can lean against the torso-engaging member and rotate the lever assembly to raise the weights, thereby exercising his abdominal muscles when facing the torso-engaging member or exercising his lower back muscles when seated with his back to the torso-engaging member.

BRIEF DESCRIPTION OF THE DRAWINGS

The novel features of the invention are set out with particularity in the appended claims, but the invention will be understood more fully and clearly from the following detailed description of the invention as set forth in the accompanying drawings in which:

DESCRIPTION OF THE INVENTION

Figure 1:
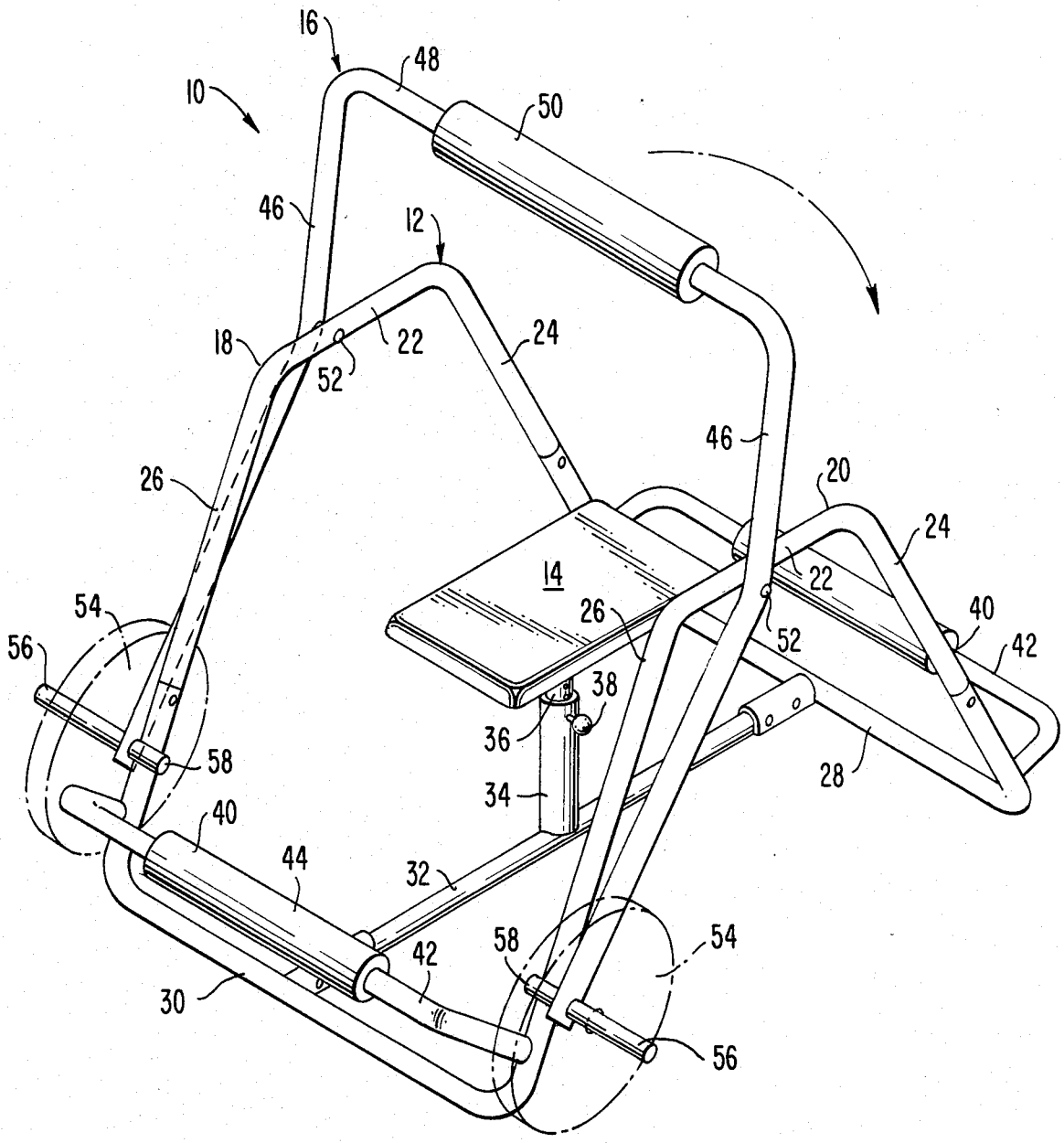
FIG. 1 is a perspective view of the abdominal/back exerciser according to the present invention.

Referring to FIG. 1, an abdominal/back exerciser 10 according to the present invention is illustrated. Exerciser 10 includes a frame 12, a seat 14 and a generally U-shaped lever assembly 16. Frame 12 includes similarly shaped, spaced side members 18 and 20. Each side member 18, 20 includes a top section 22 a downwardly and outwardly extending section 24 extending from one end of top section 22 and a downwardly and outwardly extending section 26 extending from the other end of top section 22. Opposite sections 24 are connected at their lower end by a first floor-engaging cross member 28; and the bottom ends of opposite sections 26 are connected by a second floor-engaging cross member 30. A longitudinally extending, centrally located floor-engaging member 32 is connected between floor-engaging members 28 and 30. A support cylinder 34 extends upward from the longitudinal center of floor-engaging member 34. A tube 36 is connected to and extends from the bottom of seat 14. Tube 36 has a plurality of apertures along its length. Seat 14 is thus supported at adjustable heights by securing tube 36 within cylinder 34 at appropriate height with a connecting pin 38. A foot brace 40 extends between sections 26 of side members 18, 20 on one side of seat 14 and between sections 24 of side members 18, 21 on the other side of seat 14. Each foot brace 40 is comprised of a shallow generally U-shaped bar 42 connected to and extending outwardly and upwardly from sections 24 and 26, and a cylindrical cushioning pad covering the transverse central portion U-shaped bar 40.

Lever assembly 16 is comprised of spaced, parallel side legs 46 interconnected by a transversely extending torso-engaging member 48. The central portion of torso-engaging member 48 is covered with a cylindrical cushioning pad 50. Side legs 46 are connected for pivotal motion to top section 22 of side members 18 and 20 by connecting pins 52. Weights 54 are attached to lever assembly 16 by rods 56 which extend laterally outward at the distal end of side legs 46. The size and number of weights 54, which are carried by rods 56, are varied to adjust the lever assembly's resistance to motion. Mutually facing extensions 58 of rods 56 extend laterally inwardly and function as a stop mechanism to limit the downward movement of side legs 46 to a start position wherein torso-engaging member 48 is elevated above seat 14. Downward motion of the lever arms is stopped by extension 58 contacting section 26 of side members 18 and 20.

Figure 2:
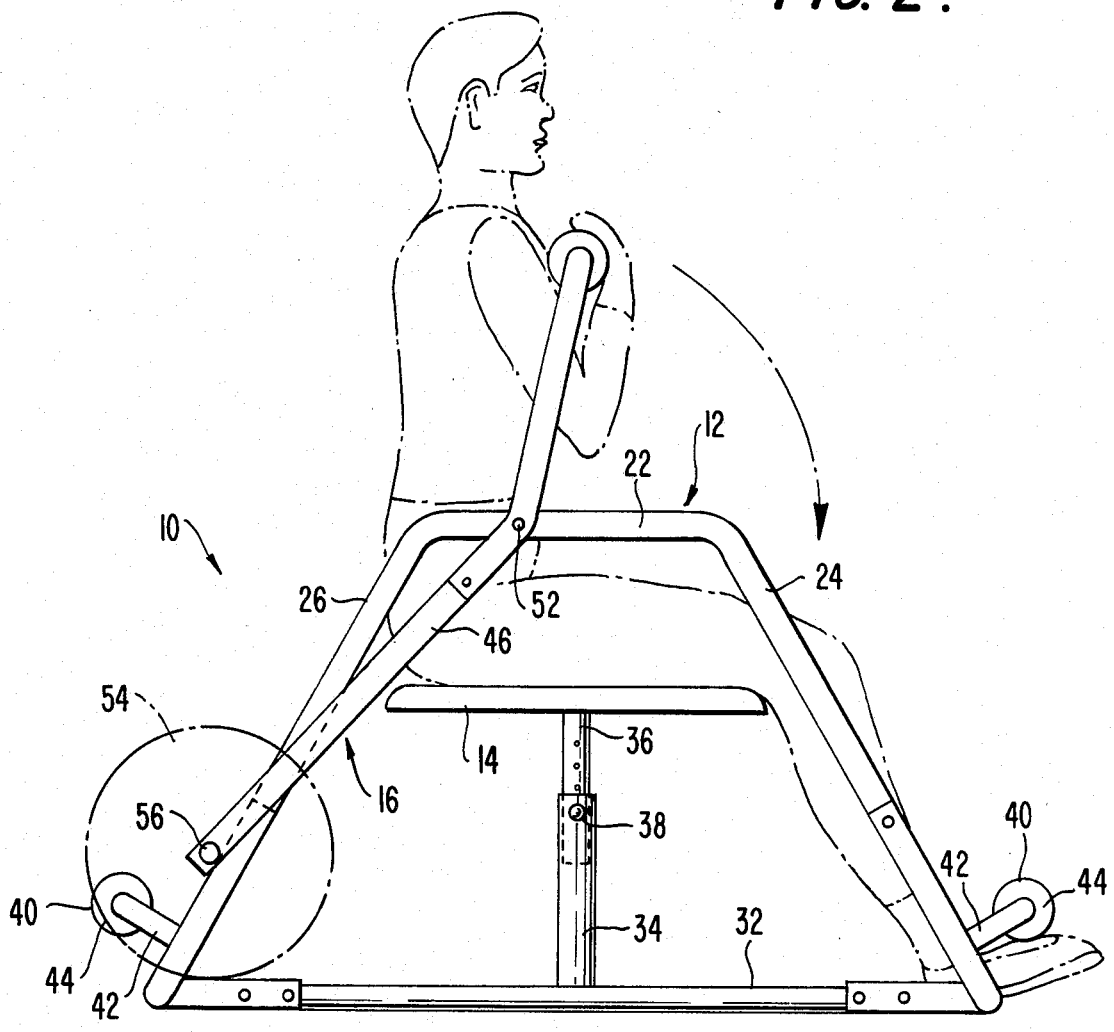
FIG. 2 is a side elevation view illustrating a user in phantom line positioned to perform abdominal exercises.

FIG. 2 illustrates a user seated on seat 40 and orientated for performing abdominal exercises. As seen therein, the user's chest faces and is contact with torso-engaging member 48 and his feet engage foot brace 40. By bending forward about his waist, the user rotates lever assembly 16 to lift weights 56, thereby exercising his abdonimal muscles. To exercise his back muscles, a user would face the opposite direction to place his back in contact with torso-engaging member 48 and lock his feet about the opposite foot brace 40. By pushing backwards against the torso-engaging member 48 with his back, the user rotates lever assembly 16 to lift weights 54 and exercise his back muscles.

While in the Figures, most of the structural elements of the invention are shown as tubular steel members which are secured together by bolted connections, it should be understood that other types of members of various cross-section may be used, and they may be secured together by other means, such as welding.

It will be obvious to one of ordinary skill in the art that numerous modifications may be made without departing from the true spirit and scope of the invention which is to be limited only by the appended claims.

We claim:

1. An abdominal/back exerciser comprising:

a frame having spaced side members;

a seat attached to said frame between said frame side members;

foot bracing means between said frame side members on each side of said seat;

a generally U-shaped lever assembly having parallel side legs pivoted intermediate their length to said frame side members about a pivot axis, and a padded torso-engaging member interconnecting said side legs;

weight mounting means at the distal end of each of said side legs for mounting selected weights; and stop means extending laterally between said side legs of said lever assembly and said side members of said frame for limiting downward movement of said side legs to a start position, said torso-engaging member being elevated above said seat in said start position so that a user seated on said seat facing said torso-engaging member may exercise the user's abdominal muscles by leaning forwardly against said torso-engaging member to rotate said lever assembly and raise said weight and so that a user seated on said seat with the user's back to said torso-engaging member may exercise the user's lower back muscles by leaning backwardly against said torso-engaging member to rotate said lever assembly and raise said weight.

2. An exerciser according to claim 1 wherein said stop means comprises mutually facing protrusions on said side legs which contact said frame side members at said start position.

3. An exerciser according to claim 2 wherein each of said weight mounting means comprises a laterally outwardly directed rod adapted to engage apertured barbell weights, and said stop means comprises mutually facing extensions of said rods.

4. An exerciser according to claim 3 wherein said seat is adjustable in height.

5. An exerciser according to claim 4 wherein each of said foot bracing means comprises a padded member interconnecting said frame side members.

* * * * *